US005586862A

United States Patent [19]

Danner

[11] Patent Number: 5,586,862

[45] Date of Patent: Dec. 24, 1996

[54] CENTRIFUGAL PUMP HAVING A SLIDABLE GATE

[76] Inventor: Michael Danner, 21 North Rd., Stony Brook, N.Y. 11790

[21] Appl. No.: 490,953

[22] Filed: Jun. 15, 1995

[51] Int. Cl.[6] ..... F04D 29/48

[52] U.S. Cl. ..... 415/146; 417/315

[58] Field of Search ..... 415/146, 911; 417/315, 442

[56] References Cited

U.S. PATENT DOCUMENTS

| | | | |
|---|---|---|---|
| 1,660,775 | 8/1928 | Faber | 415/146 |
| 4,653,977 | 3/1987 | Fries | 415/146 |
| 4,728,260 | 3/1988 | Ishii | 415/911 |
| 4,778,000 | 10/1988 | Maas | 415/146 |
| 4,874,298 | 10/1989 | Mainardi et al. | 415/911 |

FOREIGN PATENT DOCUMENTS

| | | | |
|---|---|---|---|
| 138666 | 3/1903 | Germany | 415/911 |
| 1088813 | 9/1960 | Germany | 415/146 X |
| 2199080 | 6/1988 | United Kingdom | 415/146 |

*Primary Examiner*—Edward K. Look

*Assistant Examiner*—Michael S. Lee

*Attorney, Agent, or Firm*—Galgano & Burke

[57] ABSTRACT

An AC motor driven centrifugal pump includes an AC motor, a symmetrical pump volute, and an impeller shaft which is coupled to an impeller hub having a plurality of radial vanes or fins. The pump volute is symmetrical about a vertical axis with an axial inlet port and substantially tangential side walls feeding a radial outlet port. According to the invention, a movable gate is arranged between the impeller and the outlet port. The impeller hub is arranged axially with the inlet port and has a smaller diameter than the inlet port so that fluid entering the inlet port is free to flow around the impeller hub and into the spaces between the vanes. The gate is free to move and to rest against the interior of opposite tangential side walls of the volute. When the impeller begins to turn, the pivotal gate moved under the force of the fluid flow to rest against the opposite side wall blocking the passage of fluid backflow. The gate is free to move from one side wall to the other depending on the direction of rotation of the impeller. According to a preferred embodiment of the invention, a stationary baffle is located between the gate and the impeller to further streamline and direct the flow of fluid.

13 Claims, 5 Drawing Sheets

CENTRIFUGAL PUMP HAVING A SLIDABLE GATE

BACKGROUND OF THE INVENTION

1. Field of the Invention

The invention relates to pumps. More particularly, the invention relates to a centrifugal pump driven by an AC powered permanent magnet synchronous motor.

2. State of the Art

Centrifugal pumps utilize an impeller housed in a volute. Fluid enters the volute either axially or tangentially relative to the impeller and exits either axially or tangentially depending on the direction of impeller rotation. Centrifugal pumps may be driven by an AC motor or a DC motor. In either case, the pump impeller may be magnetically coupled to the rotor of the motor so that the workings of the motor can be hermetically sealed and isolated from the fluids passing through the pump. In the case of an AC motor driven pump, the impeller may turn in either of two directions depending on the phase angle of the AC power at the moment the motor is started. In order to provide predictable operation in an AC motor driven pump, the pump volute and impeller are specially designed so that the inlet and outlet of the pump are the same regardless of the rotational direction of the impeller.

Prior art FIGS. 1 and 2 illustrate a typical AC motor driven volute pump 10. The pump 10 includes an AC motor 12, a pump volute 14, and an impeller shaft 16 which is coupled to an impeller hub 18 having a plurality of radial vanes or fins 20. The pump volute 14 is symmetrical about a vertical axis A with an axial inlet port 22 and a radial outlet port 24. Below a horizontal axis B, the volute 14 is substantially cylindrical in shape, but above the horizontal axis B, the volute tapers with substantially tangential side walls 21, 23 to the radial outlet port 24. The impeller hub 18 is arranged axially with the inlet port 22. The impeller hub 18 has a smaller diameter than the inlet port 22 so that fluid entering the inlet port 22 is free to flow around the impeller hub and into the spaces between the vanes 20. Regardless of the direction of rotation of the impeller hub 18 and vanes 20, the vanes will create a centripetal force resulting in a low pressure condition at the impeller hub 18. This low pressure condition will draw fluid into the volute 14 via the inlet port 22. The fluid will enter the spaces between the vanes 20 whereupon it will be driven radially outward from the hub 18 in either a clockwise or counterclockwise flow, and tangentially along either side wall 21 or 23, depending on the direction of flow, to the outlet port 24. Since the outlet port 23 and the side walls 21, 23 are arranged symmetrically about the vertical axis A,the radially outward driven fluid will ultimately exit the volute 14 through the outlet port 24 regardless of the direction of impeller rotation. Although this design of the volute and the impeller provides for a predictable direction of fluid flow regardless of the direction of rotation of the impeller, it does have some significant disadvantages.

In virtually every pumping operation, the exiting fluid is subject to back pressure. Since the outlet port 24 in the pump 10 is arranged symmetrically relative to the impeller, fluid under back pressure is free to re-enter the volute 14 and be recirculated by the impeller. This is illustrated in FIG. 2 by the arrows which point down from the outlet port 24. As those skilled in the art will appreciate, the problem of recirculating back flow is endemic to AC motor drive pumps using symmetrical volutes. In DC motor driven pumps, as mentioned above, the outlet port can be arranged tangentially to the impeller in an asymmetrical volute so that backflow is virtually eliminated. The problem of backflow recirculation in AC motor driven pumps decreases their efficiency since the outlet volume and pressure decreases when fluid is being recirculated.

SUMMARY OF THE INVENTION

It is therefore an object of the invention to provide a centrifugal pump which is driven by an AC motor and which has predictable fluid flow.

It is also an object of the invention to provide a centrifugal pump having a symmetrical volute which avoids the problem of backflow recirculation.

It is another object of the invention to provide a centrifugal pump which is driven by an AC motor and which operates with predictable fluid output volume and pressure.

It is still another object of the invention to provide a centrifugal pump which is driven by an AC motor and which achieves the above-mentioned objects while being inexpensive to manufacture.

In accord with these objects which will be discussed in detail below, the AC motor driven centrifugal pump of the present invention includes an AC motor, a symmetrical pump volute, and an impeller shaft which is coupled to an impeller hub having a plurality of radial vanes or fins. The pump volute is symmetrical about a vertical axis with an axial inlet port and substantially tangential side walls feeding a radial outlet port. According to the invention, gate means are arranged between the impeller and the outlet port. The impeller hub is arranged axially with the inlet port and has a smaller diameter than the inlet port so that fluid entering the inlet port is free to flow around the impeller hub and into the spaces between the vanes. The gate means includes a movable gate free to rest against the interior of opposite tangential side walls of the volute. When the impeller begins to turn and fluid is forced radially outward against one of the tangential side walls, the movable gate moved under the force of the fluid flow to rest against the opposite side wall blocking the passage of fluid backflow. The gate is free to move from one side wall to the other depending on the direction of rotation of the impeller. According to a preferred embodiment of the invention, a stationary baffle is located between the gate and the impeller to further streamline and direct the flow of fluid.

Preferably, the gate means comprises a pivotal gate. The pivotal gate is hinged at a point on the vertical axis of the volute and extends from its hinge point to the interior of a tangential side wall of the volute between the outlet port and the impeller. The gate is free to pivot about its hinge point to rest against the interior of opposite tangential side walls of the volute. When the impeller begins to turn and fluid is forced radially outward against one of the tangential side walls, the pivotal gate moved under the force of the fluid flow about its hinge point to rest against the opposite side wall blocking the passage of fluid backflow. Since the gate is hinged at the axis of symmetry of the volute, it is free to pivot from one side wall to the other depending on the direction of rotation of the impeller. According to a preferred embodiment of the invention, a stationary baffle is located between the pivotal gate and the impeller to further streamline and direct the flow of fluid.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
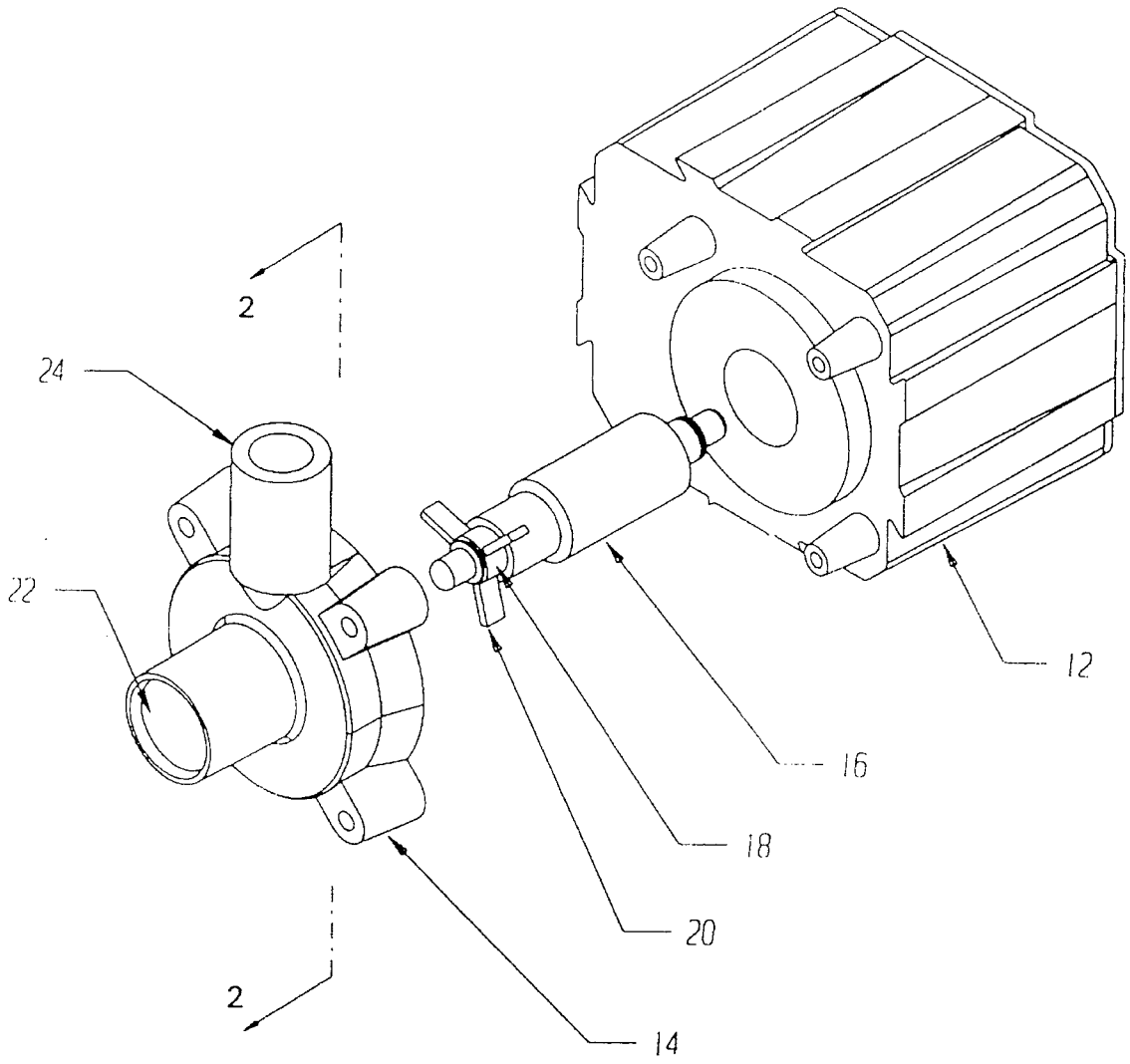
FIG. 1 PRIOR ART
FIG. 1 is an exploded perspective view of a prior art volute pump.
Figure 3:
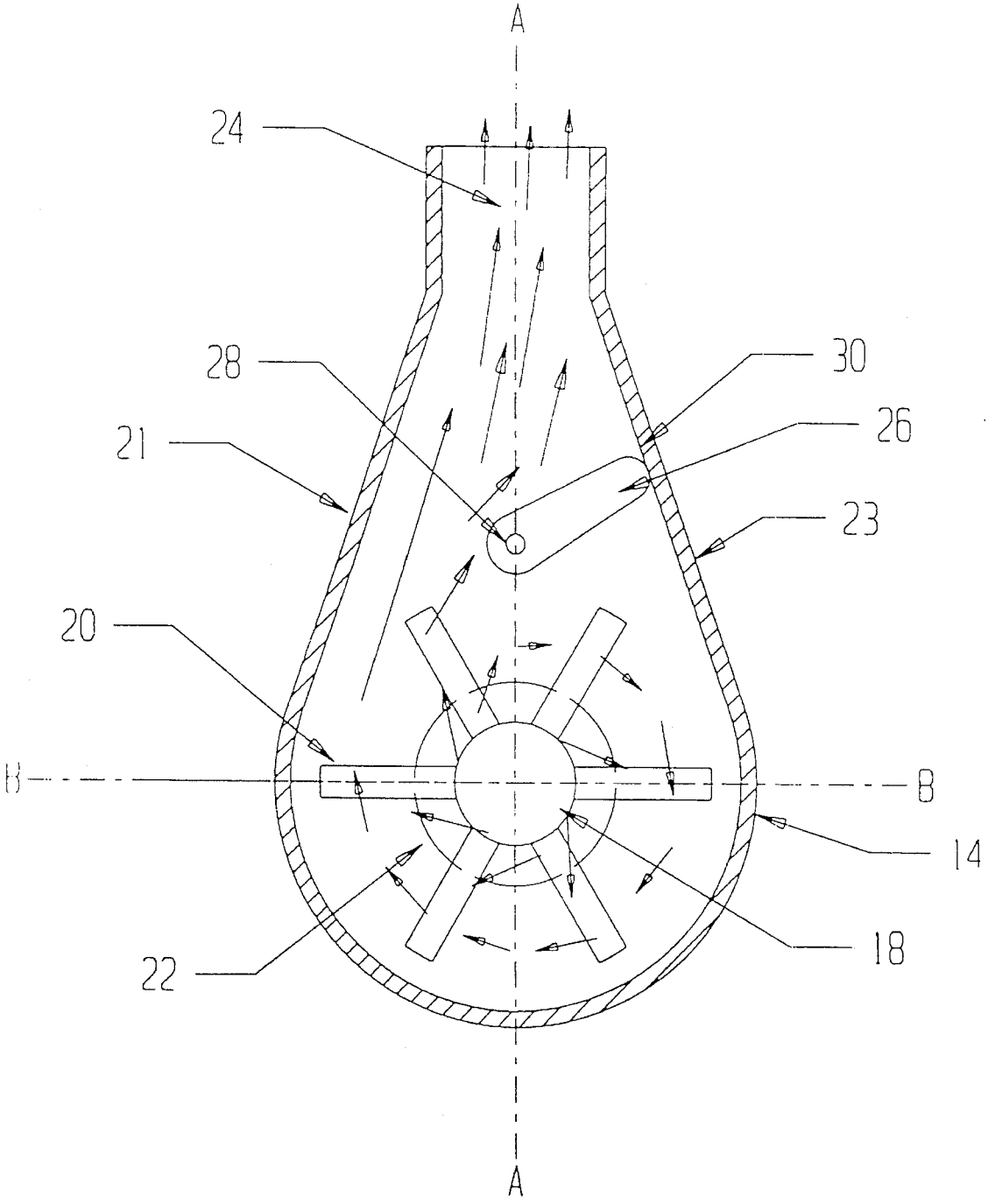
FIG. 3 is a view similar to FIG. 2 of a first embodiment of a pump volute according to the invention.

Referring now to FIGS. 1 and 3, a volute pump according to the invention incorporates many of the components of the prior art pump 10 shown in FIG. 1, including, an AC motor 12, a pump volute 14, and an impeller shaft 16 which is coupled to an impeller hub 18 having a plurality of radial vanes or fins 20. The pump volute 14 is symmetrical about a vertical axis A with an axial inlet port 22 and a radial outlet port 24. Below a horizontal axis B, the volute 14 is substantially cylindrical in shape, but above the horizontal axis B, the volute tapers with substantially tangential side walls 21, 23 to the radial outlet port 24. The impeller hub 18 is arranged axially with the inlet port 22 and has a smaller diameter than the inlet port 22 so that fluid entering the inlet port 22 is free to flow around the impeller hub and into the spaces between the vanes 20. Regardless of the direction of rotation of the impeller hub 18 and vanes 20, the vanes will create a centripetal force resulting in a low pressure condition at the impeller hub 18. This low pressure condition will draw fluid into the volute 14 via the inlet port 22. The fluid will enter the spaces between the vanes 20 whereupon it will be driven radially outward from the hub 18 in either a clockwise or counterclockwise flow, and tangentially along either side wall 21 or 23, depending on the direction of flow, to the outlet port 24. Since the outlet port 23 and the side walls 21, 23 are arranged symmetrically about the vertical axis A,the radially outward driven fluid will ultimately exit the volute 14 through the outlet port 24 regardless of the direction of impeller rotation.

According to a first embodiment of the invention, as shown in FIG. 3, a pivotal gate 26 is hingedly mounted inside the volute at a hinge point 28 which lies substantially on the vertical axis of symmetry A of the volute. The gate 26 is dimensioned so that in either of its two extreme positions it rests against the interior of a side wall 21 or 23 and blocks fluid back flow from the outlet port 24 on a respective side of the axis of symmetry A. FIG. 3 shows the gate 26 in one of its extreme positions, resting against the interior of side wall 23. Those skilled in the art will appreciate that the other extreme position is symmetrically opposite to the position shown in FIG. 3, resting against the interior of side wall 21. The gate 26 is free to pivot to either extreme position in response to fluid flow inside the volute 14.

Figure 2:
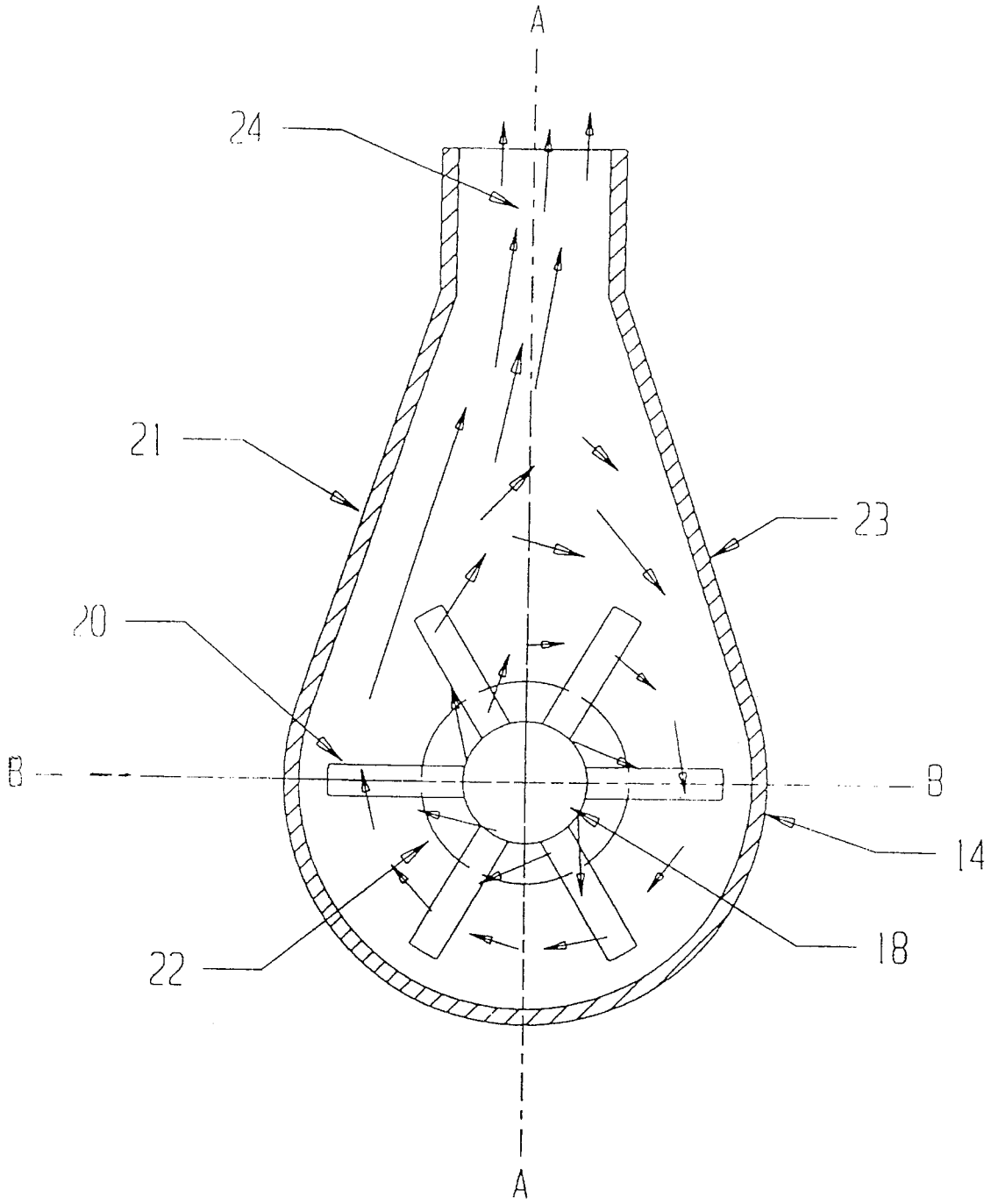
FIGURE 2 PRIOR ART
FIG. 2 is a cross sectional view of the interior of the prior art pump volute taken along line 2—2 in FIG. 1.

From the foregoing, those skilled in the art will appreciate that when the impeller rotates in a clockwise direction as shown in FIG. 3, the flow of fluid indicated by the arrows inside the volute will cause the gate 26 to assume the position shown resting against the interior of side wall 23. Comparing FIGS. 2 and 3, it will further be appreciated that this position of the gate 26 will effectively block backflow recirculation and thereby increase the volume and pressure output of the pump. It will also be appreciated that when the impeller rotates in the direction opposite to that shown in FIG. 3, the gate will assume a position opposite to that shown in FIG. 3, resting against the interior of side wall 21 and will effectively block backflow recirculation as well. Thus, the placement of the pivotal gate 26 effectively blocks backflow recirculation regardless of the direction of rotation of the impeller.

Figure 4:
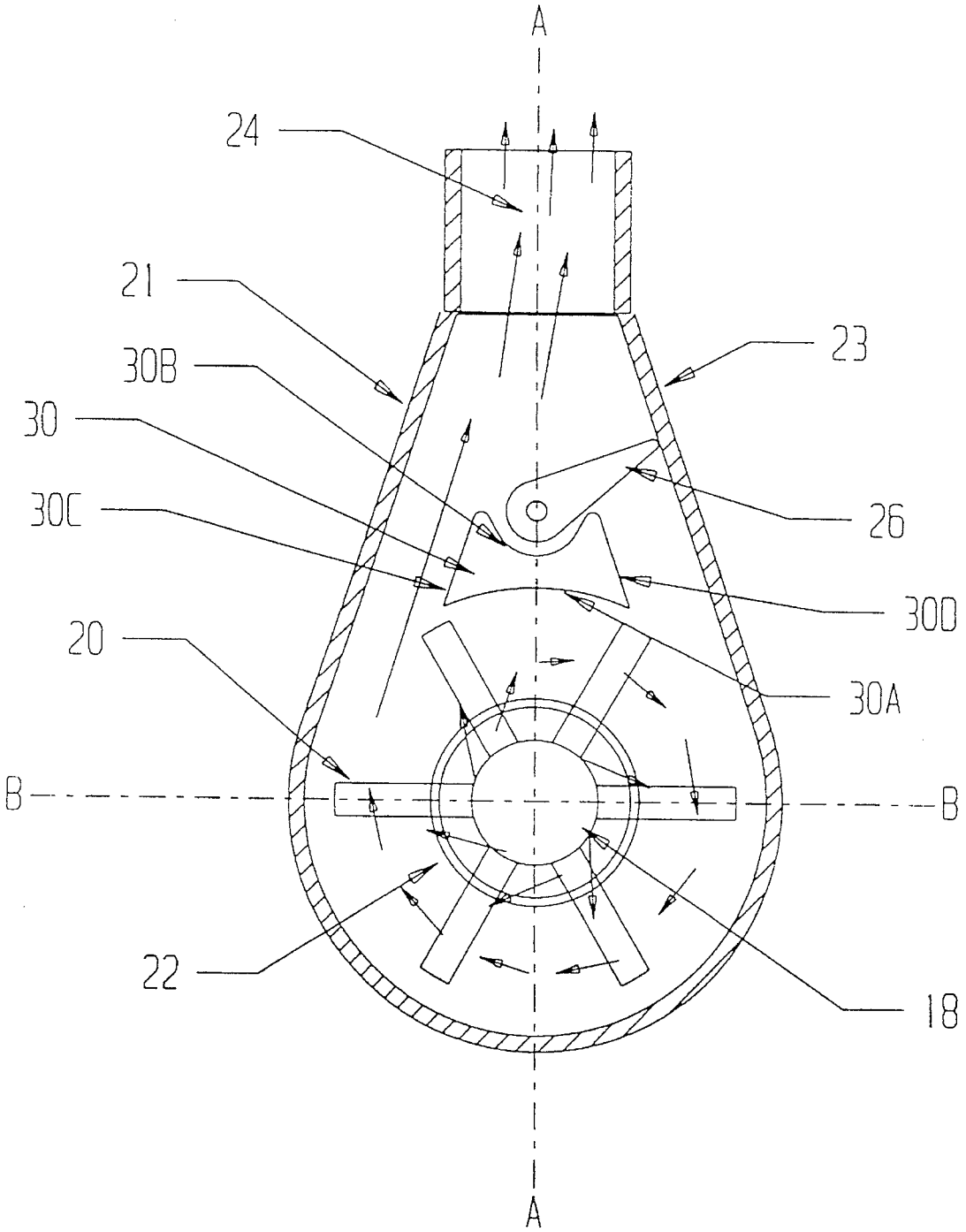
FIG. 4 is a view similar to FIG. 3 of a second embodiment of a pump volute according to the invention.

Turning now to FIG. 4, a second embodiment of the invention includes a stationary baffle 30 which is mounted inside the volute 14 between the gate 26 and the impeller vanes 20. As shown in FIG. 4, the baffle 30 has a lower concave surface **30*a* which has a radius of curvature slightly larger than the radius of the impeller, and an upper concave surface 30*b* which embraces the pivot point 28 of the gate 26. The lower surface 30*a* and the upper surface 30*b* are joined by a pair of substantially planar surfaces 30*c*, 30*d*, each of which is substantially parallel to a respective side wall 21, 23. The baffle 30 is symmetrically aligned with the axis A and serves to further direct and streamline the flow of fluid inside the volute 14**.

Figure 5:
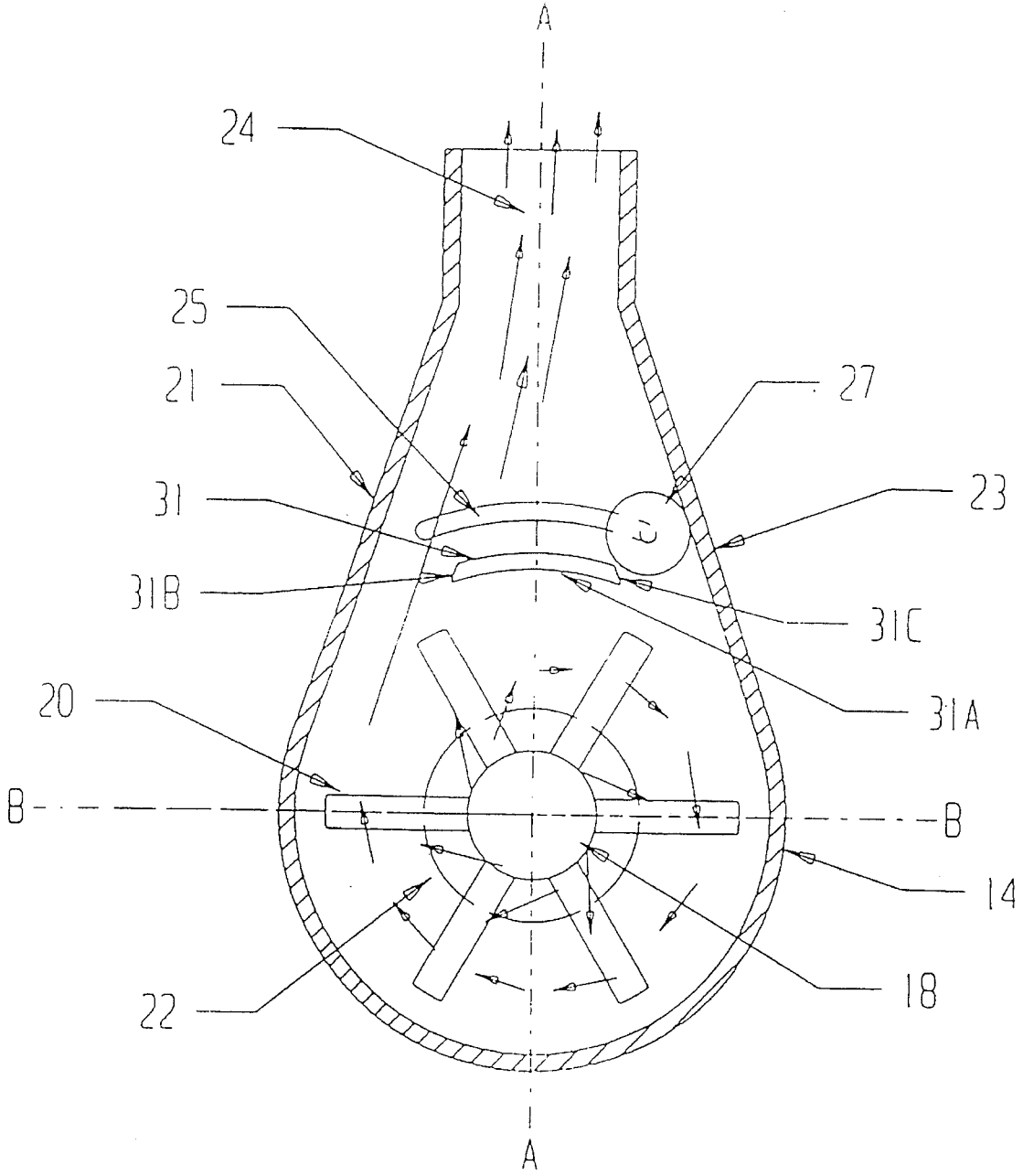
FIG. 5 is a view similar to FIGS. 3 and 4 of a third embodiment of a pump volute according to the invention.

According to a third embodiment of the invention, as shown in FIG. 5, instead of being pivotable, the gate means could instead be defined by a slidable roller 27 having end pins (not shown, which would be received in opposite arcuate tracks 25 provided in opposite side walls of the pump volute 14 at a position generally corresponding to the position of the pivot gate 26 of the previous embodiments. The roller 27 is slidably movable in tracks 25 so that in either of its two extreme positions it rests against the interior of a side wall 21 or 23 and blocks fluid backflow from the outlet port 24 on a respective side of the axis of symmetry A.

Those skilled in the art will appreciate that the other extreme position is symmetrically opposite to the position shown in FIG. 5, resting against the interior of side wall 21. The roller 27 is free to slide to either extreme position in response to fluid flow inside the volute 14.

As shown in FIG. 5, a stationary baffle 31 is mounted inside the volute between the roller 26 and the impeller vanes. In addition, the baffle 31 has two lateral end walls **31*b* and 31*c* which cooperate with the roller when in its opposite rest or end positions so as to block fluid backflow from the outlet port 24 on a respective side of the axis of symmetry. In particular, the roller 27 in addition to resting against the interior of a sidewall 21 or 23 in its two extreme positions will also contact and rest against the end walls 31*b* or 31*c* of the baffle 31 thereby effectively blocking the fluid backflow on a respective side of axis of symmetry A. As shown in FIG. 5, the baffle has a lower concave surface 31*a* which has a radius of curvature slightly larger than the radius of the impeller. The baffle 31 is symmetrically aligned with the axis A and serves to further direct and streamline the flow of fluid inside the volute 14**.

There have been described and illustrated herein several embodiments of a volute pump. While particular embodiments of the invention have been described, it is not intended that the invention be limited thereto, as it is intended that the invention be as broad in scope as the art will allow and that the specification be read likewise. Thus, while particular types of motors and impellers have been disclosed, it will be appreciated that other types of motors and impellers could be utilized with the gate volute of the invention. Also, while a motor with a magnetically coupled impeller has been shown, it will be recognized that other types of coupling of the motor and impeller could be used with similar results obtained. Moreover, while particular configurations have been disclosed in reference to the optional baffle, it will be appreciated that other configurations could be used as well.

Furthermore, while the gate means is preferably shown as being either pivotable or slidable, other gate movements are possible. Moreover, while the pivotal gate has been disclosed as having a pivot point substantially on the axis of symmetry of the volute, it will be understood that a pivot point which is slightly off the axis can achieve the same or similar function as disclosed herein.

It will therefore be appreciated by those skilled in the art that yet other modifications could be made to the provided invention without deviating from its spirit and scope as so claimed.

What is claimed is:

1. A centrifugal pump, comprising:

a) a pump volute have a substantially axial inlet port and a substantially radial outlet port and being substantially symmetrical about the axis of said outlet port, said outlet port being flanked by a first and second side wall;

b) an impeller rotatably mounted inside said pump volute;

c) a drive motor coupled to said impeller for imparting rotational movement to said impeller; and d) slidable gate means mounted between said impeller and said outlet port and including a gate slidably movable between a first position where said gate rests against said first side wall and a second position where said gate rests against said second side wall.

2. A pump according to claim 1, further comprising:

e) a stationary baffle mounted between said impeller and said gate.

3. A pump according to claim 2, wherein:

said stationary baffle has a first surface which is substantially parallel to said first side wall and a second surface which is substantially parallel to said second side wall.

4. A pump according to claim 3, wherein:

said impeller has an axis of rotation, and said stationary baffle has a concave surface having a radius of curvature which is substantially concentric with said axis of rotation.

5. A pump according to claim 1, wherein:

said volute is asymmetrical about an axis perpendicular to said axis of said outlet port.

6. A pump according to claim 5, wherein:

a portion of said volute on one side of said axis perpendicular to said axis of said outlet port is substantially cylindrical and said first and second side walls are substantially planar.

7. A pump according to claim 6, wherein:

said first and second sidewalls are disposed at an angle therebetween.

8. A pump according to claim 6, wherein:

said impeller comprises an impeller hub and a plurality of vanes extending outward from said hub, said hub having a diameter smaller than the diameter of said inlet port.

9. A pump according to claim 1, wherein:

said impeller has an axis of rotation which is substantially coaxial with said inlet port.

10. A pump according to claim 8, wherein:

said drive motor is a synchronous motor.

11. A pump according to claim 1, wherein:

said drive motor is an AC drive motor.

12. A pump according to claim 1, wherein:

said impeller has an axis of rotation which is substantially coaxial with said inlet port.

13. A pump according to claim 12, wherein:

said impeller comprises an impeller hub and a plurality of vanes extending outward from said hub, said hub having a diameter smaller than the diameter of said inlet port.

* * * * *